US009297130B2

(12) United States Patent
James

(10) Patent No.: US 9,297,130 B2
(45) Date of Patent: Mar. 29, 2016

(54) CABLE-BARRIERS

(75) Inventor: Dallas Rex James, North Harbour (NZ)

(73) Assignee: Valmont Highway Technology Limited, Auckland (NZ)

( * ) Notice: Subject to any disclaimer, the term of this patent is extended or adjusted under 35 U.S.C. 154(b) by 561 days.

(21) Appl. No.: 13/391,369

(22) PCT Filed: Aug. 26, 2010

(86) PCT No.: PCT/NZ2010/000168

§ 371 (c)(1),
(2), (4) Date: Apr. 25, 2012

(87) PCT Pub. No.: WO2011/025393

PCT Pub. Date: Mar. 3, 2011

(65) Prior Publication Data

US 2012/0199802 A1 Aug. 9, 2012

(30) Foreign Application Priority Data

Aug. 26, 2009 (NZ) ..... 579282

(51) Int. Cl.
*E01F 15/06* (2006.01)
*E01F 15/14* (2006.01)

(52) U.S. Cl.
CPC ..... *E01F 15/06* (2013.01); *E01F 15/145* (2013.01)

(58) Field of Classification Search
CPC ..... E01F 15/025; E01F 15/06; E01F 15/065; E01F 15/145; E01F 15/146
USPC ..... 256/13.1, 64; 52/148, 166
See application file for complete search history.

(56) References Cited

U.S. PATENT DOCUMENTS

| | | | | |
|---|---|---|---|---|
| 3,351,322 | A * | 11/1967 | Mueller | 256/13.1 |
| 6,109,597 | A * | 8/2000 | Sicking et al. | 256/13.1 |
| 2006/0043353 | A1 | 3/2006 | Titmus | |
| 2006/0102884 | A1 | 5/2006 | Rohde et al. | |
| 2006/0182495 | A1 | 8/2006 | Bergendahl et al. | |
| 2007/0007501 | A1 | 1/2007 | Neusch | |
| 2007/0020045 | A1 | 1/2007 | Neusch | |
| 2007/0252124 | A1* | 11/2007 | Heimbecker | 256/13.1 |
| 2008/0283807 | A1 | 11/2008 | Titmus | |
| 2009/0121205 | A1 | 5/2009 | Dallas | |

FOREIGN PATENT DOCUMENTS

WO 2007129915 11/2007

* cited by examiner

*Primary Examiner* — Josh Skroupa
(74) *Attorney, Agent, or Firm* — Greer, Burns & Crain, Ltd.

(57) ABSTRACT

A terminal post for a cable barrier which is of a unitary post construction. The integrally formed post has a cable barrier portion for retaining barrier cable(s) and an anchor-cable portion for retaining anchor cable(s). The cable barrier includes at least one cable-barrier portion which, in use, receives and retains one or more barrier-cables used in the cable barrier and at least one anchor-cable portion in the form of a central groove, which, in use, receives and retains one or more anchor-cables which are anchored so as to counter balance the force applied to the terminal post by the barrier-cable(s). The cable-barrier portion(s) and the anchor-barrier portion(s) within the post body are configured so that, in use, at least one of the anchor-cable(s) and barrier-cable(s) are releasable from the body during a collision with a vehicle where the anchor-cables act as a ramp and/or snag during the collision.

3 Claims, 3 Drawing Sheets

CABLE-BARRIERS

TECHNICAL FIELD

The present invention relates to improvements in and relating to cable-barriers. In particular, though not solely, the present invention is directed towards an improved terminal post used as part of an anchoring system for cable-barriers, used on the outer edge of roads and/or vehicle road lanes requiring separation by a barrier.

BACKGROUND ART

The present invention will now be described in relation to cable-barriers for use in relation to roading networks. However, this should not be seen as limiting, as aspects of the present invention may also have application in relation to different fields.

The applicant has previously devised an improved anchor-body and terminal post for a cable barrier which is fully described WO2007/129915. This improved terminal post overcomes the ramp and snag situations that can occur when a vehicle impacts the anchor cables of a cable barrier.

The present invention represents a further improvement to the invention in WO2007/129915 in that it provides a terminal post of unitary construction which is quick, easy and relatively cheap to manufacture yet still achieves the advantages of the terminal post taught in WO2007/129915. Conversely, the terminal post detailed in WO2007/129915 whilst effective in achieving its aims requires a separate anchor, body to be fabricated and attached to the upright member of the terminal post which is relatively time consuming and expensive.

The terminal post of the present invention therefore aims to provide a quick release mechanism which is equally effective as the terminal post of WO2007/129915 at reducing or preventing an inclined cable anchoring system from acting as a ramp or snag, during impacts from a number of different angles, particularly 'reverse' direction impacts—these are impacts that occur in a direction other than a substantially head on impact.

It would therefore be useful to have a cable-barrier system or release mechanism that could withstand impact from collisions from both directions. Additionally, it would also be useful to have a cable-barrier which can release the anchor-cable downwardly extending from the terminal post of a cable-barrier, in situations where the anchor-cables are capable of acting as a ramp or snag during a collision.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF THE INVENTION

A terminal post for a cable barrier which includes:

post body;

wherein the post body itself is of unitary construction and has been adapted to include:

- at least one cable-barrier portion which has been adapted to, in use, receive and retain one or more barrier-cables used in the cable-barrier;
- at least one anchor-cable portion which is adapted to, in use, to receive and retain one or more anchor-cables which are anchored so as to counter balance the force applied to the terminal post by said barrier-cable(s);

wherein said cable-barrier portion(s) and said anchor-barrier portion(s) within said post body are configured so that the anchor-cables and/or barrier-cables are capable of being released therefrom, during a collision with a vehicle, in situations where said anchor-cables are capable of acting as a ramp and/or snag during said collision.

In preferred embodiments, the cable-barrier portion is configured to allow the cables to exit therefrom in a substantially horizontal direction.

It is envisaged the post body may be made in a variety of different ways without departing from the scope of the present invention.

In preferred embodiments the post body may be made via a mould and casting process.

In some other embodiments the post body may be made from cutting or otherwise forming from a piece of material.

The post body may be adapted in a variety of different ways to provide the anchor-cable and cable-barrier portions without departing from the scope of the present invention.

In some embodiments the post may have a body which may be substantially H-shaped in nature with a cross bar and two uprights either side thereof, wherein the post body includes:

- a top section above the cross bar wherein the two uprights may be configured to receive and retain barrier-cables on the outer sides of said uprights to create a cable-portion; and
- a bottom section beneath the cross bar wherein the area between the two uprights is configured to receive and retain the anchor cables to form an anchor-portion.

In some other embodiments the post may have a body which may be substantially T-shaped in nature with:

- a central slot in the middle of the T-bar for receiving and retaining the barrier-cables forming a cable-portion; and
- downwardly projecting protrusions at the distal ends of the T-bar which create a slot between the protrusion and the upright of the T for receiving and retaining the anchor cables to form an anchor-portion.

In preferred embodiments the post may have a body which may substantially resemble an inverted V-shape wherein:

- the region underneath the apex and between the inclined arms is configured to form a slot for receiving and retaining the anchor cables to form an anchor-portion; and the outer sides of the arms proximate the apex have slots, which are upwardly inclined with respect to the horizontal, for receiving and retaining the barrier-cables to form a cable-portion.

In preferred embodiments the cable and anchor portions may be configured so that the surface(s)/edge(s) which abut(s) the washer and nut of a respective cable is/are angled substantially between 91°-95° with regard to the longitudinal axis of the cable. The inventor has found this non-orthogonal angling of the washer relative to the direction of the tensional force of the cable, creates increased frictional pressure to help retain the tensioned cables within the slots.

The cables in the barrier are generally tensioned as is customary in the art.

According to a further aspect of the present invention there is provided a cable barrier which includes a terminal post substantially as described above.

According to another aspect of the present invention there is provided an energy absorbing apparatus which includes a terminal post substantially as described above.

Thus, preferred embodiments of the present invention may have a number of advantages over the prior art which can include:

A terminal post which can retain and release anchor cables and/or barrier cables upon a collision event in situations where said anchor-cables are capable of acting as a ramp and/or snag during said collision.

A terminal post which is of a unitary construction.

A terminal post which is relatively inexpensive and quick to manufacture.

The structural integrity of the post is not reliant on welding.

A terminal post which releases barrier cables from the top of the post. This effects a faster release near a vehicle's centre of gravity and thereby minimizes the risk of the anchor cables snagging on a vehicle.

BRIEF DESCRIPTION OF DRAWINGS

Further aspects of the present-invention will become apparent from the following description which is given by way of example only and with reference to the accompanying drawings in which.

BEST MODES FOR CARRYING OUT THE INVENTION

Figure 1:
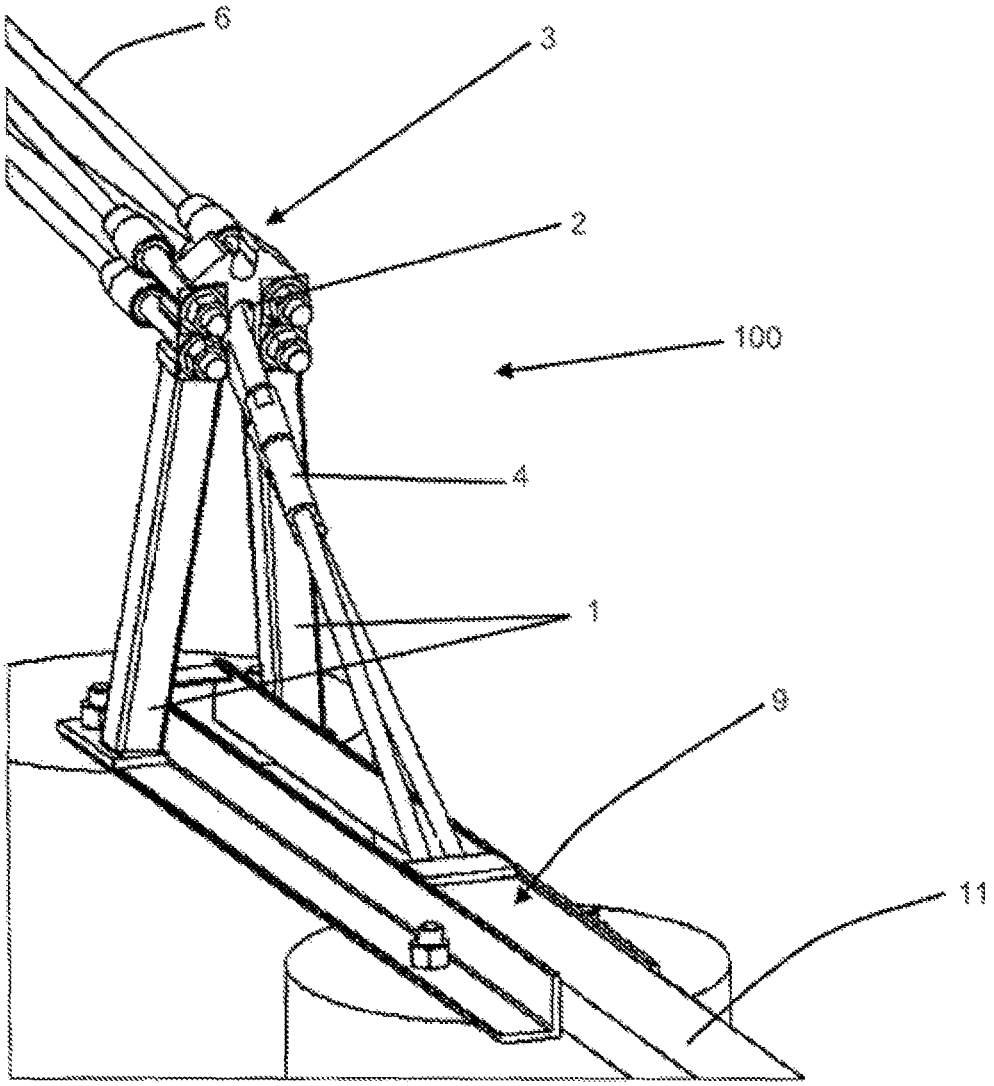
FIG. 1 shows a prospective view of a terminal post in accordance with one preferred embodiment of the present invention.
Figure 2:
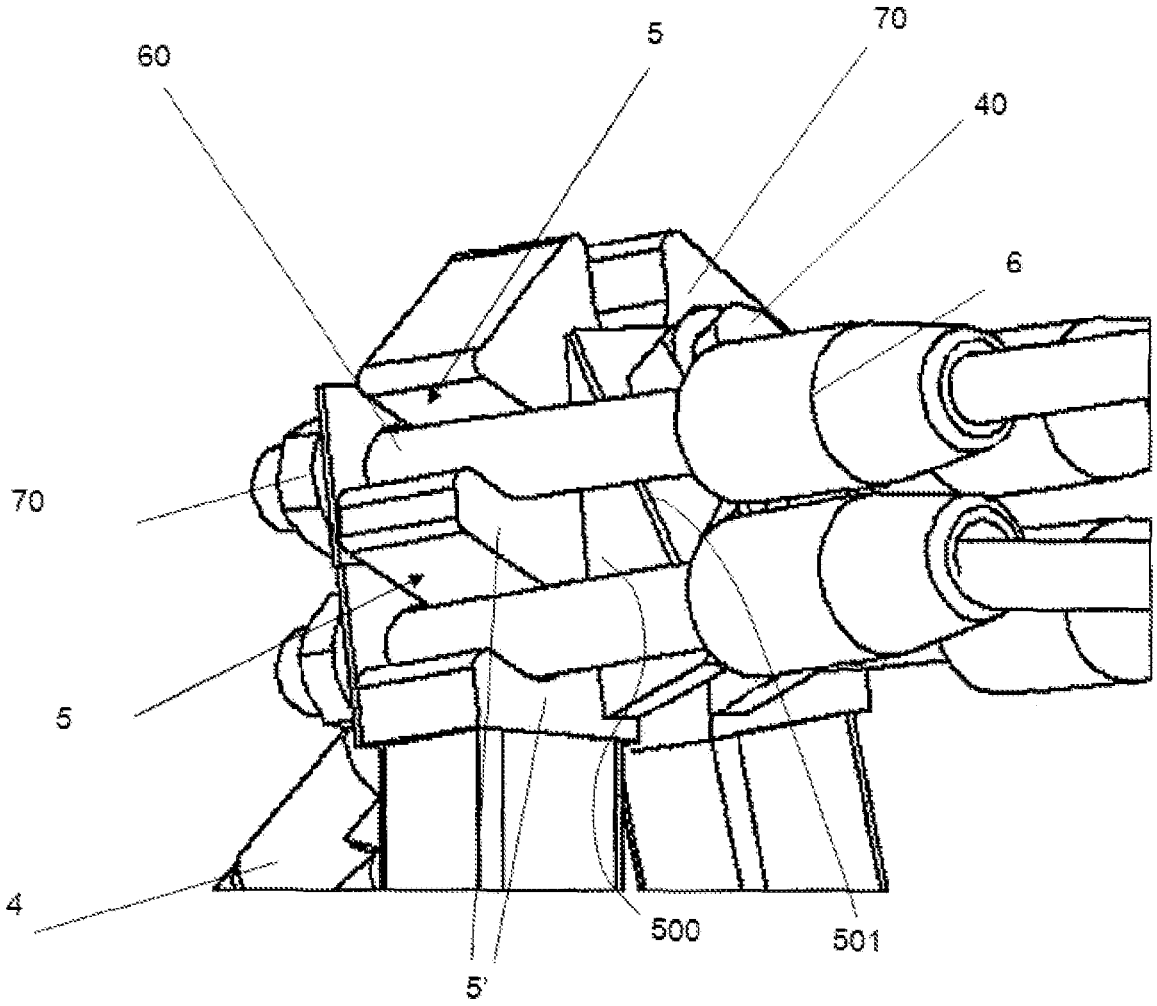
FIG. 2 is a close up perspective view of the top of the terminal post shown in FIG. 1.

With respect to FIGS. 1-2 there is provided a terminal post (100) which has two converging uprights (1) which form a substantially inverted V-shape. The post (100) has an anchor-cable portion in the form a slot (2), located between the uprights (1) and beneath the top (3) of the post (100), in which one end of anchor cables (4) are retained. The back of the slot (2) includes, on either side, two angled walls (500) having outer edges (501). The angle that the outer edges (501) intersect the longitudinal axis of the anchor-cables is preferably an angle of around 92°. The opposite end of the anchor cables (4) are connected to one end (10) of a horizontal ground anchored member (11). The anchor cables (4) pass from post (100) to one end (9) of the member (11) which is hollow through to the other end (10). The angle of anchor cables (4) is substantially 45° or more with regard to the horizontal. This helps ensure the anchor cables (4) drop out of the slot (2) up on a head on impact occurring.

On the outside edges of the top (3) of the post (100) there are formed cable-barrier portions in the form of slots (5), which are partially upwardly inclined with respect to the horizontal, which receive and retain one end of barrier cables (6).

The ends of the respective anchor cables (4) and barrier cables (6) have threaded portions (40 and 60 respectively) thereon which allow for a nut and washer arrangement (70) to retain the cables within the slots (2) and (5).

Figure 3:
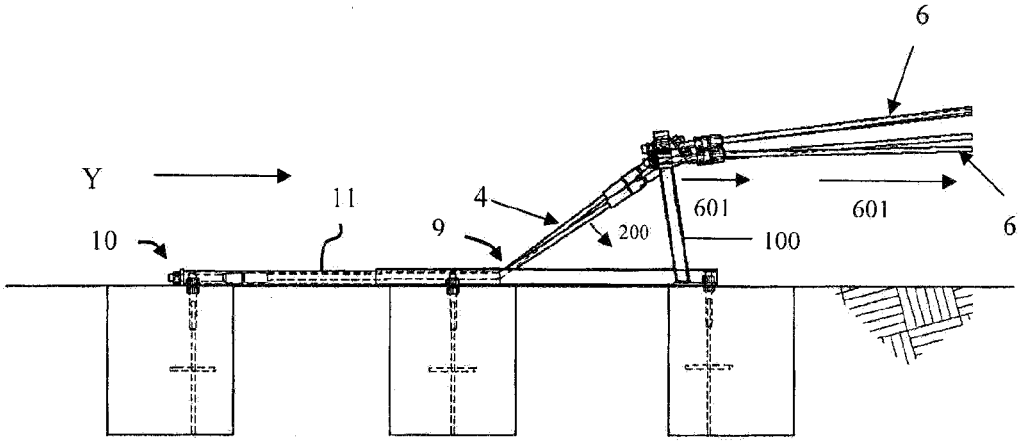
FIG. 3 shows a partial side elevation view of a cable-barrier in accordance with the preferred embodiment of the present invention.

As shown in FIG. 3, in use, if a vehicle travelling in direction Y hits or contacts the anchor-cables (4) the resultant force from the impact moves the anchor-cables (4) substantially in the direction of arrow (200) which releases the anchor-cables (4) from the terminal post (100).

As the cables (6) of the cable-barrier (1) are held under tension in the direction of arrow (600) the release of the anchor-cables (4) causes the terminal post (100) to deform substantially in the direction of arrow (601) and as a consequence the cables (3) move in a substantially horizontal direction after being levered over the bottom wall (5') of the slot (5) and are released from slots (5) of the post (100).

A similar net result occurs if a vehicle impacts into the terminal post (100) itself as any substantial deformation of the terminal post (100) causes the respective release of the cables (6) and/or anchor-cables (4) from the slots (5) of the terminal post (100). This is also the outcome of when a vehicle impacts the anchor-cables (4), or the terminal post (100) itself substantially side-on. Here, the force causes the terminal post (100) to twist or buckle, due to the opposing forces between the cable tension and direction of force caused by the impact.

In addition, in use if a vehicle impacts the terminal post (100) from a reverse direction, this also causes the cables (6) to lever out of slots (5).

In use the cables (6) are released from the slots (5) in a substantially horizontal direction after being levered over the bottom walls (5) of the slot (5).

Aspects of the present invention have been described by way of example only and it should be appreciated that modifications and additions may be made thereto without departing from the scope of the appended claims.

What I claim is:

1. A terminal post having a top section which is of one piece construction which allows for direct transfer of load from anchor cable(s) to a cable barrier, and allows release of the anchor cable(s) at a height above ground level, said post having a body which substantially resembles an inverted V-shape, wherein the body comprises:

a region underneath an apex and between inclined arms forming the V-shape, said region configured as a slot for receiving and retaining the anchor cable(s) to form an anchor-portion; and outer sides of the inclined arms proximate the apex, include channels, which are upwardly inclined with respect to the horizontal, for receiving and retaining, in use, barrier-cable(s) to form a cable-portion.

2. A cable barrier which includes a terminal post as claimed in claim 1.

3. An energy absorbing apparatus which includes a terminal post or post as claimed in claim 1.

* * * * *